US006033192A

United States Patent [19]

Wood

[11] Patent Number: 6,033,192

[45] Date of Patent: Mar. 7, 2000

[54] FLUID TRANSFER SYSTEM

[75] Inventor: Richard Roy Wood, Randburg, South Africa

[73] Assignee: Nicro Industrial Close Corporation, Stormill, South Africa

[21] Appl. No.: 08/940,967

[22] Filed: Sep. 30, 1997

[51] Int. Cl.[7] ..... F04B 43/06

[52] U.S. Cl. ..... 417/395; 417/286; 137/630.14

[58] Field of Search ..... 417/286, 395, 417/601; 137/630.14, 630.22

[56] References Cited

U.S. PATENT DOCUMENTS

| | | | |
|---|---|---|---|
| 1,062,213 | 5/1913 | Delaunay-Belleville | 137/630.14 |
| 2,403,427 | 7/1946 | Ludeman | 251/14 |
| 3,937,599 | 2/1976 | Thureau et al. . | |
| 4,523,901 | 6/1985 | Schippers | 417/395 |
| 4,763,484 | 8/1988 | Osenberg et al. . | |
| 4,962,394 | 10/1990 | Sohmiya et al. . | |
| 4,991,998 | 2/1991 | Kamino et al. . | |
| 5,006,896 | 4/1991 | Koichi et al. . | |
| 5,038,175 | 8/1991 | Sohmiya et al. . | |
| 5,500,720 | 3/1996 | Karasawa . | |

FOREIGN PATENT DOCUMENTS

| | | |
|---|---|---|
| 3108936 | 9/1982 | Germany . |
| 3221531 | 12/1983 | Germany . |
| 3226708 | 1/1984 | Germany . |
| 3606935 | 9/1987 | Germany . |
| 3706025 | 7/1988 | Germany . |
| 3926464 | 2/1991 | Germany . |
| 82/0078 | 1/1982 | South Africa . |
| 87/3617 | 5/1987 | South Africa . |
| 87/4735 | 6/1987 | South Africa . |
| 93/2292 | of 0000 | South Africa . |
| 102730 | 5/1917 | United Kingdom . |
| 945624 | 1/1964 | United Kingdom . |
| 2161519 | 1/1986 | United Kingdom . |

*Primary Examiner*—Timothy S. Thorpe
*Assistant Examiner*—Ehud Gartenberg
*Attorney, Agent, or Firm*—McDermott, Will & Emery

[57] ABSTRACT

This invention relates to a fluid transfer system including two elongated fluid transfer chambers, fluid inlet and outlet arrangements at each end of each chamber, oppositely directed one-way inlet and outlet valves in the inlet and outlet arrangement at a first end of each chamber for controlling the flow of a driven fluid into and out of the chamber, oppositely direted inlet and outlet controlled valves in the inlet and outlet arrangement at the second end of each chamber for controlling the flow of a drive fluid into and out of the chamber, a pressure balancing arrangement including a port in each of the controlled valves, an actuator on each controlled valve which is adapted to open and to close the valve and the pressure balancing port in the valve, and a control system which is connected to the actuators of each of the controlled valves for proportionally opening and closing the controlled inlet valves of each chamber in exact opposite phase to each other and for opening and closing the controlled chamber outlet valves to ensure full volume continuous drive fluid flow through the system in dependence on the state of the drive and driven fluids in each of the transfer chambers.

19 Claims, 7 Drawing Sheets

FLUID TRANSFER SYSTEM

FIELD OF THE INVENTION

This invention relates to a fluid transfer system for transporting a driven fluid from one location to another by means of a second high pressure drive fluid and more particularly relates to such a system for use in underground mine cooling and the transport of a liquid slurry from underground mine workings to surface.

BACKGROUND TO THE INVENTION

In deep level mining operations cold water is used extensively to cool underground work places. The water is chilled on surface and is piped to underground locations where the cooling is required. The resultant hot water is then pumped back to surface where it is again cooled and the cycle is repeated. Because of the water pressure head which exists at mine depths of thousands of meters the hot water pumping costs are enormous and it is not uncommon to employ power recovery systems such as Pelton wheel generating sets which use the cold water head to generate electricity to supplement the energy required for operating the pumps.

To minimise the above pumping and related costs, underground chamber water transfer systems were experimented with in South African mines in the early 1970's. The principle of operation of these systems is the charging of a chamber with a low pressure driven liquid or slurry from the underground mine workings and then to discharge the water or slurry from the chamber through a pipeline to surface by means of high pressure drive cold water from surface. The cold water is then discharged from the chamber to a cold water tank by the reintroduction of hot water into the chamber. The cold water from the tank is used for the cooling of the mine workings with the so heated water being pumped to a hot water tank for transmission through the chamber back to surface.

Over the years single, double and triple type chamber systems have been experimented with with typical examples of these being those disclosed in South African patent Nos. 82/0078, 87/3617, 87/4735 and U.S. Pat. No. 4,991,998. The double chamber systems were not reliable and the continuity of delivery of the driven liquid from the systems was problematical and could not be guaranteed. Flow interruptions in the systems caused, among other problems, severe water hammer. In practice the high pressure pipe lines to and from the underground system would have a nominal bore of about 200 mm and would need to cope with 120 bar water pressure. Water hammer in such a system would at the very least be traumatic. The more continuous flow achieved with the three chamber systems reduced problems which existed in the two chamber systems and, unlike the two chamber systems, were developed to actual use. However, even the three chamber systems have problems and are not totally reliable.

The most common problems connected with all known fluid transfer systems of the above type are:

- The extremely large and costly underground excavations which are required to accommodate the pipe chamber feeders of the systems which are made from heavy piping which is as long as 100 m and which is folded into the form of a U.
- Water hammer in all of these systems which remains an ongoing problem.
- The control valves for operating the pipe feeders; with the vast majority of these valves being expensive and difficult to control high pressure gate valves which require use of external pressure balancing valves. As the valve switching is time or volume dependent they are responsible for a phenomenon known as "system creep" which results in the interface between the hot and cold water in the chambers creeping one way or the other over prolonged use of the system which is difficult to detect and eventually results in a total break down of the efficiency of the system.
- In many of the known fluid transfer systems the transfer chambers do not include any means for separating the hot from the cold water in the chamber and although a natural barrier appears to exist between the two liquids in normal operation of the system any deviation in the system timing will cause the hot water to temperature contaminate the cold water adversely to affect the mine cooling aspect of the system. This problem becomes highly aggravated in systems in which the driven liquid is a slurry.
- The thermal efficiency of the known pipe feeder systems is low as the internal surface area of the long pipe chamber feeders is very large and in each cycle of operation of the chamber becomes heated by the incoming hot water and then again cooled by the incoming cold water to result in a significant increase in the temperature of the cold water which is displaced from the chamber to the cold water tank.

SUMMARY OF THE INVENTION

A fluid transfer system according to the invention includes

- two elongated fluid transfer chambers,
- fluid inlet and outlet arrangements at each end of each chamber,
- oppositely directed one-way inlet and outlet valves in the inlet and outlet arrangement at a first end of each chamber for controlling the flow of a driven fluid into and out of the chamber,
- oppositely directed inlet and outlet controlled valves in the inlet and outlet arrangements at the second end of each chamber for controlling the flow of
- a drive fluid into and out of the chamber,
- a pressure balancing arrangement including a port in each of the controlled valves,
- an actuator on each controlled valve which is adapted to open and close the valve and the pressure balancing port in the valve, and
- a control system which is connected to the actuators of each of the controlled valves for proportionally opening and closing the controlled inlet valves of each chamber in exact opposite phase to each other and for opening and closing the controlled chamber outlet valves to ensure full volume continuous drive fluid flow through the system in dependence on the state of the drive and driven fluids in each of the transfer chambers.

Each of the chamber controlled valves conveniently includes a housing having an inlet and an outlet, a valve seat in the housing, a valve member which seats on the valve seat to close the valve in the direction of fluid flow through the valve, a valve stem which is connected to the valve member and which is movable by the actuator to open and close the valve and the fluid pressure balancing port to a fluid passage which passes through the valve member. Preferably, the valve member and its seat are circular, the valve member is axially holed, the valve stem is movable in its axial direction in the hole, and the valve stem includes a stop on the downstream side of the valve member for lifting the valve member from its seat, a secondary valve member on the stem on the upstream side of the valve member for closing the pressure balancing port when the valve is closed and for opening the port to balance fluid pressure across the valve member when the valve member is about to be opened.

Each of the controlled valve actuators may be a hydraulic piston and cylinder actuator which is attached to the valve housing with the piston rod extending from the actuator into the housing to provide the valve stem. A closed hydraulic circuit is preferably connected to and hydraulically links the valve actuators for exact opposite concomitant movement.

The hydraulic circuit in the preferred form of the invention, includes a change-over switch for reversing the direction of movement of the two actuator pistons on instruction from the control system and a fluid flow equalizer for ensuring balanced hydraulic fluid volume flow and exact opposite common speed of operation of the two valve actuators irrespective of any hydraulic load which is imposed on the valve members of the valves.

Further according to the invention the transfer chambers are elongated pressure vessels and include a fluid divider in the vessel, for separating the drive and driven fluids, which is movable by fluid pressure in the vessel between the two end zones of the vessel, and switch means in the vessel which is activated by the fluid divider for activating the inlet and outlet controlled valves of each of the vessels at predetermined positions of the divider in the vessel in use. Conveniently, the transfer chambers have a length to diameter ratio of between 2,5 and 3,5 to 1. The switch means in the chambers are conveniently connected to the control system which switches the actuator hydraulic change-over valve in dependence on the position of the fluid dividers in the chambers.

Each of the chamber outlet controlled valve actuators may each include a dedicated hydraulic circuit for controlling it and the valve to which it is attached with the control system being adapted to control the two hydraulic circuits on instruction from the chamber switch means.

Still further according to the invention both the drive and driven fluids are liquids and the system includes a line for feeding the drive liquid to the chamber controlled inlet valves at high pressure, a line for feeding drive liquid from the chamber controlled outlet valves to tank at low pressure, a line for feeding the driven liquid through the chamber one-way inlet valves into the chambers, a line for conveying the driven liquid from the chamber one-way outlet valves, a line which extends between the high pressure liquid feed line and the driven liquid conveying line and a one-way pressure relief valve in the line which opens into the driven liquid conveying line.

In one form of the invention the fluid transfer system is situated underground for mine cooling with; the drive liquid feed line extending to the system from means on surface for feeding cold water into the line under pressure, the line for conveying the driven liquid extending from the system to the surface for conveying hot water from the mine, the low pressure drive liquid line extending from the chamber controlled outlet valves to an underground cold water tank from which the water is used for mine cooling and then fed to a hot water tank, the line for feeding the driven liquid to the chamber one-way inlet valves extending from the hot water tank to the valves for feeding hot water into the chambers through the valves and the system includes a pump for pumping the hot water from the hot water tank to the chamber inlet valves, and a one-way dump valve in the driven liquid line between the hot water tank and the chamber one-way inlet valves for dumping the pumped hot water back to the hot water tank when the water pressure in the line exceeds a preset pressure.

In another form of the invention the drive liquid is clean water and the driven liquid is a slurry and the fluid transfer chambers are vertically orientated with their first ends lowermost.

Still further according to the invention each transfer chamber includes a rod which is coaxially located in and extends over the length of the vessel, switches which are carried in a spaced relationship by the rod, a sleeve to which the fluid divider is attached, and which is slidably located on the rod and means on the sleeve for activating the switches. Preferably, the rod is hollow and the divider position sensors are located in the rod. The rod is conveniently made from a non-magnetic material, the switches in the rod are magnetically operable, and the fluid divider sleeve carries a magnet for activating the switches.

In one embodiment of the invention the fluid divider is a disc which is fixed to the sleeve and extends between the sleeve and the inner wall of the vessel. Preferably, however, the fluid divider is a bladder which is fixed to and extends between the inner wall in the longitudinal central zone of the vessel and the sleeve and is so dimensioned and sufficiently flexible to be moved by fluid pressure in the vessel from one end zone of the vessel to the other. The fluid divider is optimally made from a thermal insulating material and the internal surface of the fluid transfer chamber is lined with a thermal insulating material.

BRIEF DESCRIPTION OF THE DRAWINGS

The invention is now described by way of example only with reference to the drawings in which.

DETAILED DESCRIPTION

Figure 1:
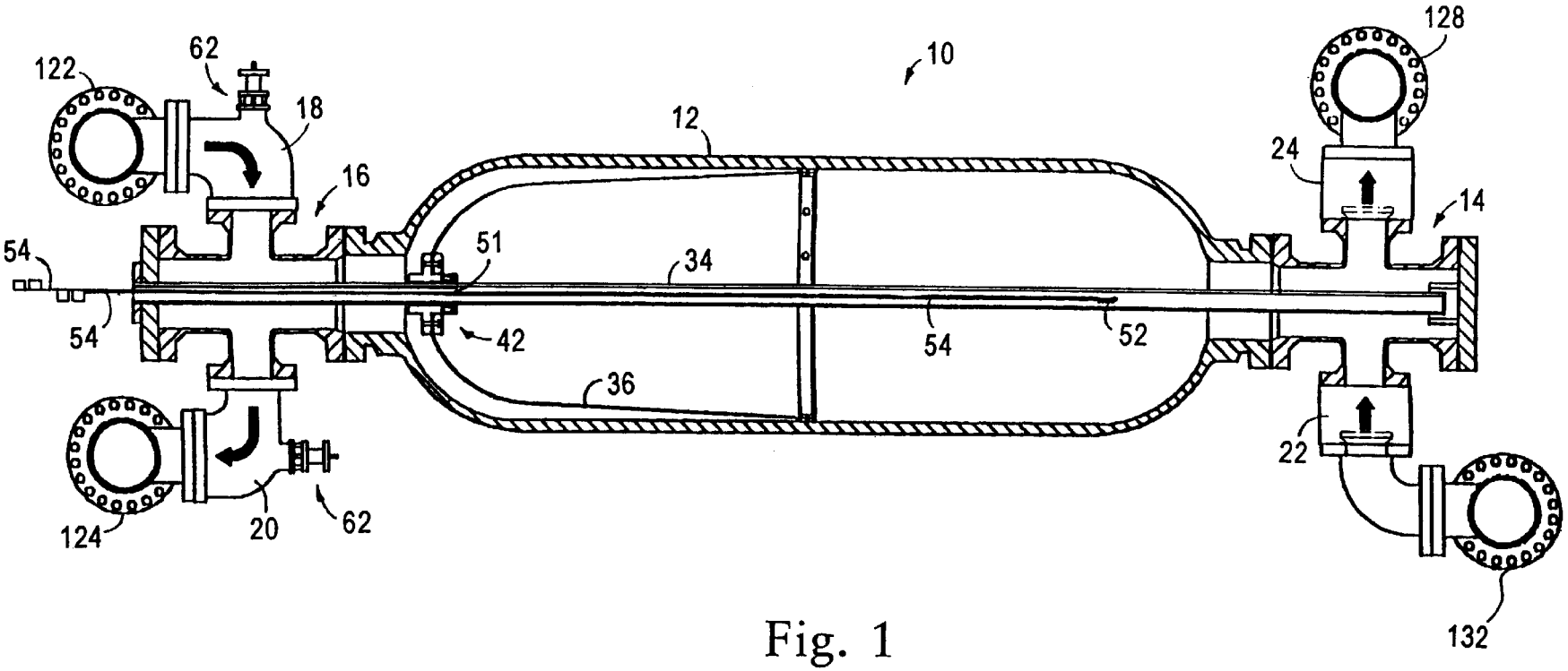
FIG. 1 is a sectioned side elevation of a liquid transfer chamber including its inlet and outlet valves, FIG. 2 are details illustrating the location of the liquid divider bladder in the FIG. 1 chamber.

The liquid transfer chamber 10 of the invention is shown in FIG. 1 to include an elongated pressure vessel 12 which is at least capable of withstanding water pressures in the region of 200 bar. In this embodiment of the invention the chamber has in practice a diameter of 1,5 m and a length of 6.0 m and its internal surface is lined with a thermal insulating material, not shown, to minimise heat exchange between the vessel metal and the water in it in use.

The chamber carries, at each of its ends, water inlet and outlet manifolds 14 and 16. The manifold 16 carries controlled inlet and outlet valves 18 and 20 respectively and the manifold 14 conventional inlet and outlet one-way valves 22 and 24 respectively. The controlled valves 18 and 20 are shown connected into cold water pipe lines 122 and 124 and the one-way valves are connected to hot water pipe lines 128 and 132, the purpose of which will be explained below.

The chamber 10 additionally includes an axially located hollow rod 34 and a flexible hot and cold water separating bladder 36.

The rod 34 is closed at its right end with the closed end located in a locating socket in the manifold 14, as shown in the drawing. The opposite end of the rod is open and passes through an end plate of the manifold 16 as shown in the drawing. The rod 34 is made from a non-magnetic material such as austenitic stainless steel.

The bladder 36 is, in this embodiment, made from a flexible polyurethane elastomer. As the bladder is, in use, exposed to only very small pressure differentials across it it need not be robust and as a result has a thickness of only 3 mm. The bladder is dimensioned to enable it to be moved between the position shown on the left in the drawing and a similar position at the right end of the chamber 10. As is more clearly seen in FIG. 2 the circumferential edge portion of the bladder 36 is fixed to the inner chamber wall by being clamped between a ring 38 which is fixed to the wall of the chamber and a clamping ring 40 which need not necessarily be continuous and may be divided into segments. The bladder is additionally fixed to a shuttle 42 which includes a sleeve 44 which is freely slidable on the rod 34 and carries a radially directed flange 46. The centre of the bladder 36 is holed with the holed portion located over the sleeve 44 of the shuttle and clamped against the flange 46 by a clamping ring 48. The shuttle sleeve includes a plurality of blind bores which are equally spaced around the sleeve with each of the bores carrying a magnet 50 with all of the magnets having the same polar orientation and a closure member for trapping the magnets in the bores.

Figures 2, 8:
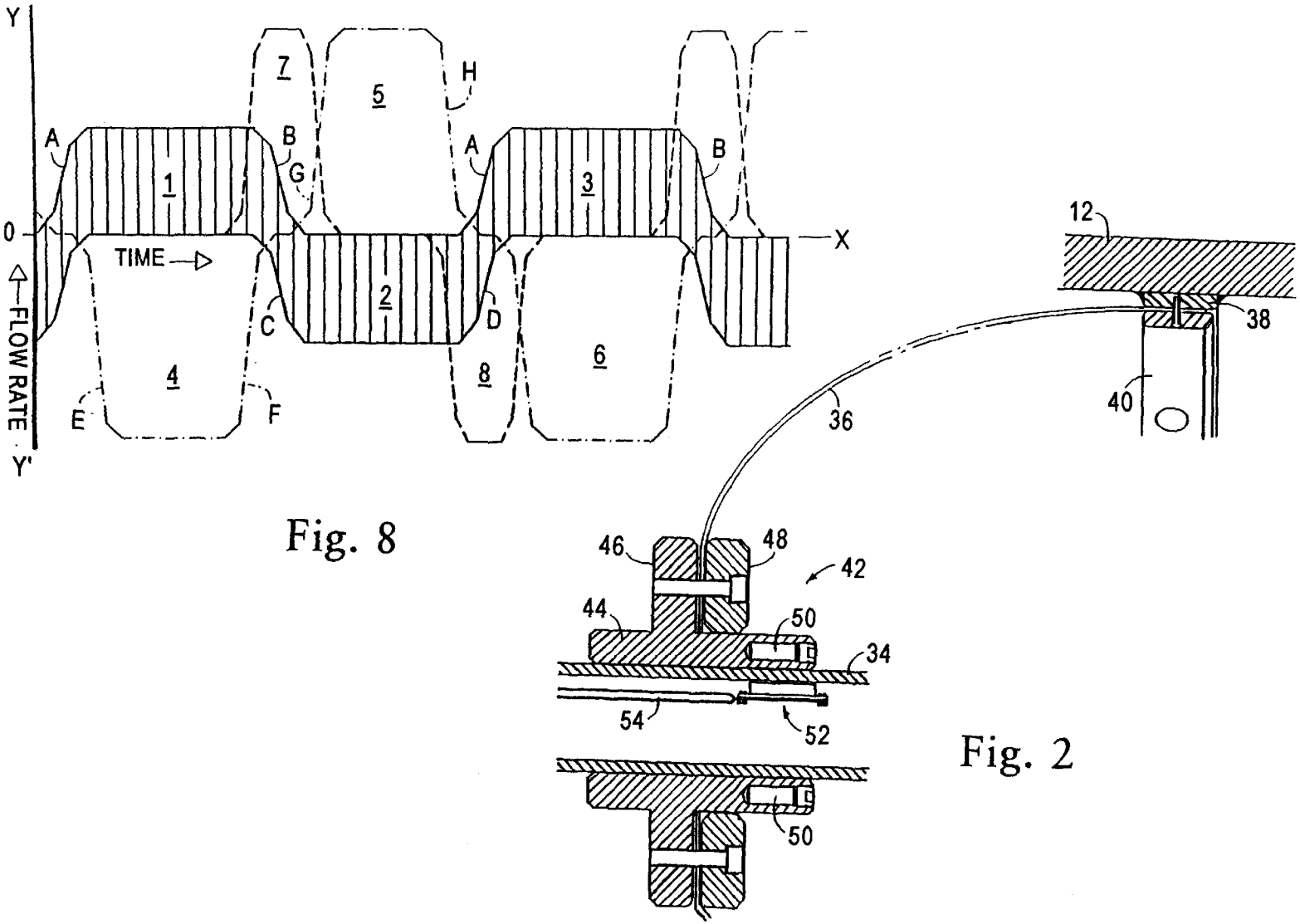
FIG. 8 is a graphic illustration of the valve sequencing and water flow in the FIG. 7 system.

Magnetically activated reed switches 51 and 52, with only switch 52 being shown in FIG. 2, are located in the bore of the tube 34. The reed switches 51 and 52 are each carried on a flattened end of an aluminium tube 54 with the free ends of the tubes 54 projecting from the open end of the rod 34 as shown in FIG. 1. The switch tubes 54 are supported in the tube 34 in holed spacer plates, not shown, in the tube. The blanked end of the manifold 16 through which the rod 34 passes includes means for locking the tubes 54 to the blanking plate with the locking means being adjustable so that the position of the switches may be adjustable in an axial direction in the tube 34. The switches 51 and 52 are activated magnetically by the shuttle magnets when the shuttle on the rod 34 is over the switches.

The chamber one-way valves 22 and 24 are oppositely mounted on the manifold 14 and are operated automatically as a consequence of the operation of the system.

The control valves 18 and 20 in FIG. 1 are identical but are oppositely mounted on the chamber manifold 16 as shown in the drawing.

Figure 3:
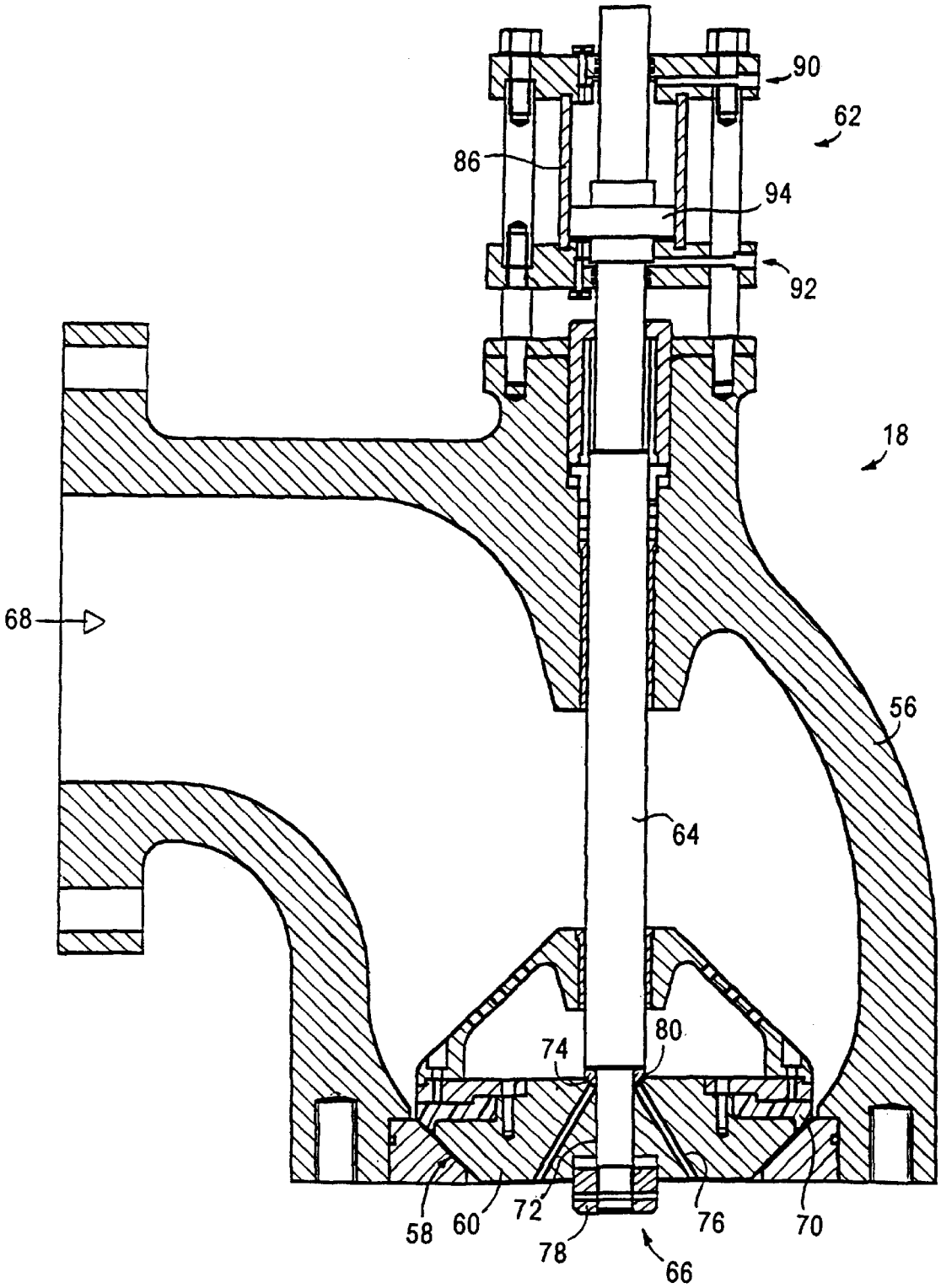
FIG. 3 is a sectioned side elevation of a controlled valve for use with the chamber of FIG. 1 in the fluid transfer system of the invention.
Figure 4:
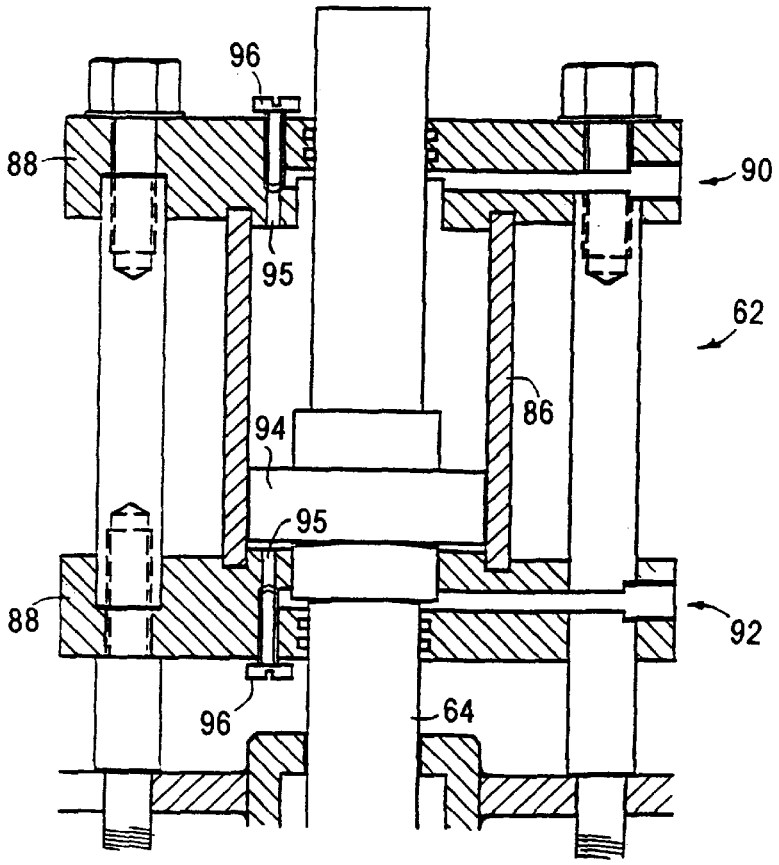
FIG. 4 is an enlarged detail of the actuator of the FIG. 3 controlled valve.
Figure 5:
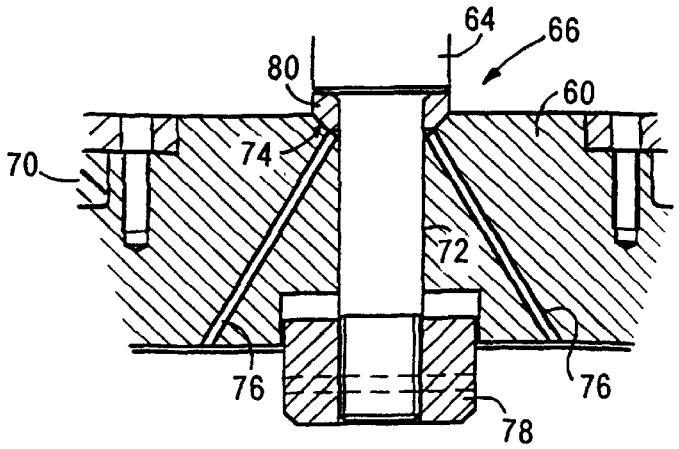
FIG. 5 is an enlarged detail of the pressure balancing arrangement of the valve of FIG. 3.

The inlet valve 18 is shown in FIGS. 3 to 5 to include a housing 56, a valve seat 58 which defines the valve housing outlet, a valve member 60, an actuator 62, a valve stem 64, a pressure balancing arrangement 66 and a flanged inlet 68.

The valve member 60 is a circular plug valve and includes in its seating surface a proud deformable polyurethane insert 70 and an axial valve stem passage 72. The pressure balancing arrangement 66 includes a valve seat 74 which is tapered inwardly into the valve stem passage 72 through the valve member and pressure balancing passages 76 which pass through the valve member 60 from ports in the valve seat 74. The valve stem 64 carries a stop nut 78 which is locked to the free end of the stem on the underside of the valve member 60. The nut is movable by the stem in the axial direction of the stem in a recess in the underside of the valve member as shown in FIG. 5. The valve stem additionally carries a secondary valve member 80 which is fixed to the stem and which is positioned on the stem to be clear of the valve seat 74 when the nut 78 is fully lifted into the valve member recess, and to seat on its seat when the nut is not bearing on the valve member as shown in FIG. 5.

The valve stem extends from the valve member 60 to and through the actuator 62, slidably through a high pressure gland arrangement in the housing as shown in FIG. 3.

The actuator 62 is a double acting cushioned piston and cylinder device as shown in FIG. 4 and includes a cylinder 86 having end closures 88 through which the valve stem is movable. The cylinder end closures include inlet and outlet hydraulic fluid ports 90 and 92. Fluid passages lead from the end closure ports 90 and 92 to piston cushion recesses in the end closures. The actuator piston 94 carries projecting cushion bosses which at the upper and lower ends of the piston travel in the cylinder 86 enter the cushion recesses in the cylinder. Second fluid passages 95 connect each cushion chamber to the cylinder, as shown in the drawing, with the fluid flow through each of the passages 95 being adjustable by a fluid flow restrictor screw 96. The actuator is fixed to the valve housing 56 by bolts which pass through its end closures 88 as shown in FIGS. 3 and 4.

In use, in the fluid transfer system of the invention, the inlet 68 to the valve 18 is bolted to the high pressure water pipe 122 and its outlet to the manifold 16 as shown in FIG. 1. As will be explained below in greater detail with reference to FIG. 7, the upper surface of the valve member in FIG. 3 is exposed to water at a pressure which may exceed 120 bar (12 MPa) which will exert a force in excess of 470 KiloNewton, through the valve member 60, onto the valve seat 58 of the valve. The underside of the valve member is exposed to a small volume of water which is trapped in the chamber 10 and in the manifold 16 at a far lesser pressure than that of the water in the valve housing and the valve member is therefore, prior to opening in use, very firmly locked, by the drive water pressure, onto its valve seat 58.

Figure 6:
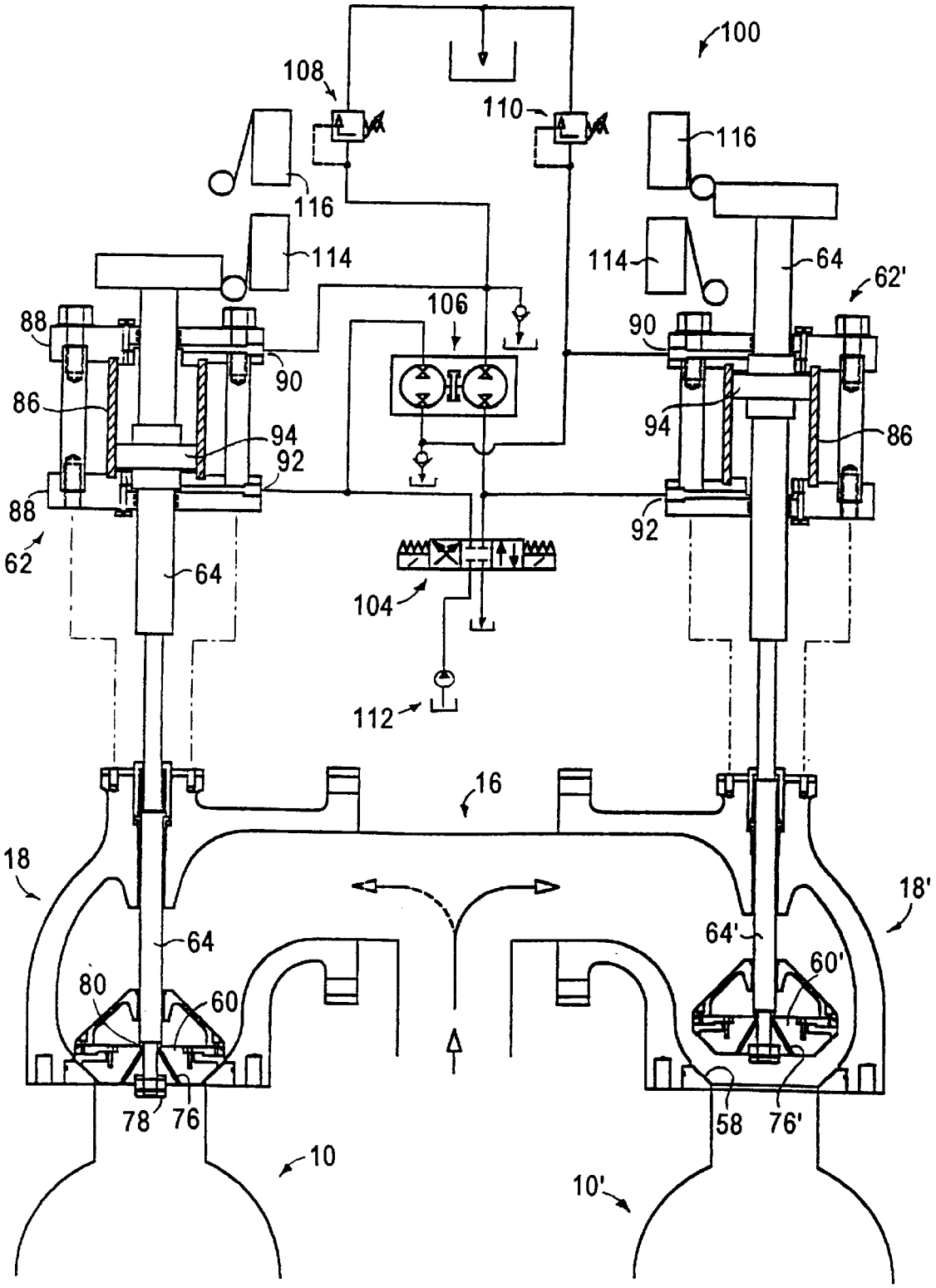
FIG. 6 is a hydraulic circuit for operating the valve actuators of the controlled inlet valves to the FIG. 1 chambers.

The inlet and outlet ports 90 and 92 of the actuator are connected into the hydraulic circuit of FIG. 6 which supplies hydraulic fluid to the actuator ports.

To open the valve 18 against the high pressure drive water, hydraulic fluid is introduced through the port 92 into the actuator cylinder 86 below the piston 94 to cause the piston to be lifted in its cylinder while fluid in the cylinder is exhausted from the port 90. The lifting actuator piston raises the valve stem until the stop nut 78 abuts the valve member 60 in the nut recess while the secondary valve member is lifted from its seat 74. At this point further movement of the valve stem is stalled by the water load on the valve member 60. With the secondary valve member 80 clear of its seat water is injected from the ports in the valve seat through the fluid passages 76 in the valve member and into the water volume on the down stream side of the valve member 60 to cause the water pressure across the valve member to balance. With the water pressure balanced or nearly so the hydraulic fluid pressure acting on actuator piston 94 lifts the actuator piston and so the valve stem to lift the valve member 60 from its seat to open the valve to water flow.

To close the valve 18 the hydraulic fluid flow direction through the actuator 62 is reversed to lower the valve member 60 back onto its seat. In closing, the only force acting on the valve member 60, other than the applied valve stem force, will be only a small force caused by water flow dynamics over the valve member. In the final closing stage of the valve 18 only a small pressure differential will exist across the valve member 60 as the down stream water pressure will be almost that of the supply water pressure, the secondary valve 80 is still open, and the valve member will seat gently onto its seat to close the valve whereafter the secondary valve 80 closes. Although not shown, the secondary valve member could include means, such as a spring, to bias it away from its seat 74 until it is fully closed by actuator force. In any event, the cushioning effect provided by the lower boss on the actuator piston entering its cushion recess in the closure 88 and the preadjusted throttling effect provided by the fluid flow restrictor screw 96 on the exhaust hydraulic fluid from the actuator cylinder will prevent the valve member 60 from being slammed onto its seat. Additionally, as will be explained below, the hydraulic circuit which controls the controlled valve actuators is adapted to prevent any discrepancy in the rate of movement of the two actuator pistons so totally eliminating the possibility of the valve member 60 slamming onto its seat.

Figure 7:
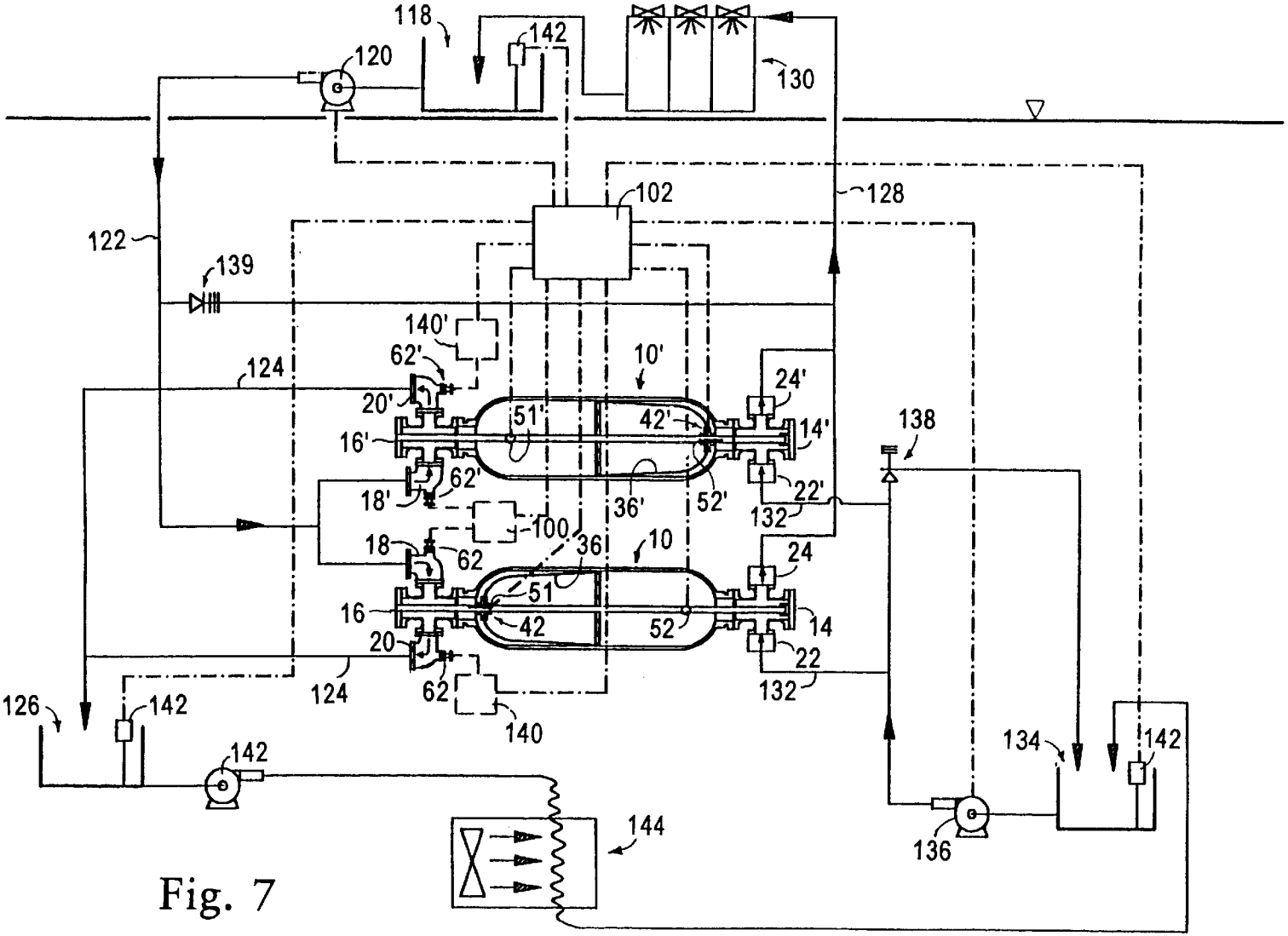
FIG. 7 is a circuit diagram of the fluid transfer system of the invention as used for mine cooling.

The fluid transfer system of the invention is shown in FIG. 7 to include two of the FIG. 1 transfer chambers with the lower chamber being numbered 10 and the upper chamber 10$^1$ in the drawing. The components of the chamber 10$^1$ are similarly marked.

It is critical to the successful operation of the system that the controlled inlet valves 18 and 18$^1$ to the two chambers are continuously concomitantly operated out of phase with each other proportionately to obtain uninterrupted drive water flow through the system. This is achieved by a closed hydraulic feed circuit 100 to the actuators 62 of the valves 18 and 18$^1$. The hydraulic circuit 100 is switched by a programable logic controller (PLC) 102 in response to information from the chamber switches 51, 52 and 51$^1$, 52$^1$.

The concomitant inversely proportional operation of the actuators of the valves 18 and 18$^1$ is now explained with reference to FIG. 6 in which the hydraulic circuit 100 is shown to include a change-over valve 104, a flow equalizer 106 and two reset valve arrangements 108 and 110.

The change-over valve 104 causes hydraulic fluid under pressure from a source 112 to reverse the fluid flow direction between the cylinders of the two actuators 62. The fluid flow equalizer 106 controls fluid flow in the circuit between the actuators to ensure balanced volume flow and exact common speed of operation of the actuators against variations in the fluid forces acting on the valve members 60 and 60$^1$ in the valves 18 and 18$^1$ in use. The reset valves 108 and 110 operate to eliminate any discrepancy or creep in the simultaneous out of phase operation of the actuators which ensures continuous out of phase exact proportional operation of the two valves 18 and 18$^1$, as illustrated in FIG. 6, where the valve member 60 in the chamber 10 is shown on its seat and that in the chamber 10$^1$ is shown at its fully open position.

The ends of the valve stem 64 which project from the upper ends of the actuators are adapted to operate fully closed and fully open switches 114 and 116 respectively. The switches 114 and 116 are connected to the PLC with their switch signals serving as positive confirmation to the PLC of the fully opened and closed positions of the two valves 18 and 18$^1$.

As mentioned above, the two chamber system illustrated in FIG. 7 is intended for use in deep level mine cooling and in addition to the chambers 10 and 10$^1$ together with their valves, the hydraulic circuit 100 and PLC 102 includes the following components: a surface cold water dam 118, a cold water pump 120 for pumping water at a pressure of about 10 bar, a high pressure cold water pipe 122 which extends from surface to the chamber valves 18 and 18$^1$ at the mine level at which the fluid transfer system is located, low pressure cold water pipes 124 which extend between the controlled chamber outlet valves 20 and 20$^1$ and a cold water dam 126, a high pressure hot water main 128 which extends between the chamber one-way outlet valves 24 and 24$^1$ and a heat exchanger 130 on surface from where the now cooled hot water is fed to the dam 118, low pressure hot water pipes 132 through which hot water from a dam 134 is pumped by a pump 136 to the chamber one-way inlet valves 22 and 22$^1$, an externally weighted positive acting one-way dump valve 138 for bypassing hot water from the pump 136 back to the dam 134 when necessary, a cold water bypass one-way pressure relief valve 139 which is connected between the cold water pipe 122 and the hot water main 128 and two individual hydraulic circuits 140 for operating the actuators of the chamber controlled outlet valves 20 and 20$^1$.

The mine cooling arrangement of the system of the invention is conventional and includes a low pressure pump 142 which feeds cold water from the dam 126 to an air heat exchanger 144, cooling sprays and so on with the so heated water being fed back to the hot water dam 142 as illustrated in the drawing.

The system control PLC 102 is connected to the various system components including water level sensors 142 in the water dams 118, 126 and 134 as shown by chain lines in the drawing.

The priming sequence of the FIG. 7 system is as follows: the hot water main 128 is water filled from surface, control valves 20 and 20$^1$ are manually closed and valves 18 and 18$^1$ are opened. The cold water pipe 122 is now partially filled from surface until both chambers 10 and 10$^1$, their manifolds 16 and 16$^1$ and the valves 18 and 18$^1$ are water filled with only a few meters of water head in the pipe 122. The chambers 10 and 10$^1$ each include an air vent valve, not shown, at each end which are opened until water emerges from the valves which are then closed and the valves 18 and 18$^1$ are manually closed. Both chamber bladders 36 will now be located at the right hand ends of the chambers with no meaningful water pressure differential across them. The pipe 122 is water filled through the pump 120 to the cold water dam 118. The hot water pump 136 is now activated and the valve 20 from the chamber 10 is manually opened to cause water to be pumped by the hot water pump 136 through the one-way inlet valve 22 into the chamber 10 to move the bladder 36 to the left hand end of the chamber 10, as shown in the drawing, and in so doing to discharge the cold water from the chamber 10 through the open valve 20 to the tank 126. When the bladder shuttle 42 reaches the magnetic switch 51, the chamber controlled valve 20 is manually closed. The hot water pressure in the chamber 10 will build up to ±0,5 bar, which is a pressure determined by the pump 136 and the preset opening pressure of the hot water dump valve 138, and the hot water will now merely be circulated by the pump 136 through the valve 138 back to dam 134. Hot water will additionally be pumped into the chamber 10$^1$ through its inlet valve 22$^1$ to water fill the end of the chamber behind the bladder 36$^1$ and its valve manifold 14$^1$ to the ±0,5 bar pressure. The cold water pump is now activated and, as the chamber inlet valves 18 and 18$^1$ are closed the pumped cold water will merely circulate through the bypass valve 139, the heat exchanger 130 and back to dam 118. The system is now fully primed with all valves closed and both pumps 120 and 136 running to circulate water through the valves 139 and 138.

The operation of the fully water primed system is now described in sequence commencing with the activation of the PLC 120.

(a) The actuator of the inlet valve 18 to the chamber 10 is activated by the hydraulic circuit 100 to lift its valve stem 64 to raise the chamber cold water pressure, through its pressure balancing arrangement 66, to the water supply pressure (±120 bar) in the pipe 122 and then fully to open the valve 18 as described above. The incoming cold water to the chamber 10 causes the bladder 36 to be moved away from the chamber switch 51 towards the switch 52 and in so doing forces the hot water in the chamber from the outlet valve 24 into the hot water main 128 towards the surface.

(b) When inlet valve 18 is fully opened the PLC instructs the valve $\mathbf{20}^1$ of the chamber $\mathbf{10}^1$ to open to reduce the cold water pressure in the chamber $\mathbf{10}^1$ to atmosphere.

(c) Hot water is now pumped into the chamber $\mathbf{10}^1$ through valve $\mathbf{22}^1$ to displace the cold water from the chamber through the valve $\mathbf{20}^1$ to the dam 126 by movement of the bladder and its shuttle 42 towards chamber switch $\mathbf{51}^1$.

(d) The hot water pump is ±25% volumetrically oversized with respect to the pump 120 and will so cause the bladder $\mathbf{36}^1$ and its switching shuttle $\mathbf{42}^1$ to move towards the left in the chamber $\mathbf{10}^1$ faster than the time it will take for the bladder 36 and its shuttle 42 in the chamber 10 to be moved to the right by the cold water and, as a consequence, shuttle $\mathbf{42}^1$ will reach the chamber switch $\mathbf{51}^1$ well before shuttle 42 reaches switch 52.

(e) When shuttle $\mathbf{42}^1$ reaches the switch $\mathbf{51}^1$ the outlet valve $\mathbf{20}^1$ of the chamber $\mathbf{10}^1$ is instructed by the PLC 120 to commence closing. The limit switch 114 on the valve $\mathbf{20}^1$ actuator 62 (FIG. 6) confirms full closure of the valve $\mathbf{20}^1$ to the PLC. The pressure of the hot water which h as entered the chamber $\mathbf{10}^1$ through its inlet valve $\mathbf{22}^1$ now builds up to ±0,5 bar and the hot water dump valve 138 opens to circulate the water from the pump 136 back to dam 134 while awaiting the arrival of the bladder 36 and its shuttle 42 at the switch 52 in the chamber 10.

(f) When the shuttle 42 in chamber 10 reaches the switch 52 the PLC instructs the hydraulic circuit 100 to commence closing valve 18 and opening valve $\mathbf{18}^1$ proportionally as described above.

(g) The limit switch 114 (FIG. 6) on the actuator of valve 18 confirms the closure of valve 18 to the PLC and cold water at 120 bar is trapped in the chamber 10.

(h) On receiving confirmation from limit switch 114 on the actuator of the valve 18 that the valve is closed the PLC will instruct the hydraulic circuit 140 to commence opening valve 20.

(i) As described above the pressure balancing arrangement 66 on valve 20 is now opened and water flows through the ports 76 in the valve member to drop the ±120 bar cold water pressure in the chamber 10 to atmosphere prior to the valve being fully opened by its actuator.

(j) Because of the out of phase relationship of the valves 18 and $\mathbf{18}^1$, the bladder shuttle $\mathbf{42}^1$ in the chamber $\mathbf{10}^1$ has in the meanwhile moved from the chamber switch $\mathbf{51}^1$ and is moving towards the switch $\mathbf{52}^1$ on the right of the chamber $\mathbf{10}^1$ and the hot water in the chamber is being forced through the valve $\mathbf{24}^1$ to surface in the hot water main 128.

(k) When the bladder shuttle 42 in the chamber 10 reaches the chamber switch 51 valve 20 will be instructed to commence closing, limit switch 114 confirms closure of the valve 20 and PLC awaits the arrival of the bladder shuttle $\mathbf{42}^1$ at the switch $\mathbf{52}^1$ to signal the commencement of the next change-over cycle without any interruption of water flow through the system.

The operating sequence of the system as described above is illustrated graphically in FIG. 8 in which the vertical axis of the graph is water flow rate and the horizontal axis time. The cycle curves above the horizontal axis X of the graph illustrate the filling and emptying of the system chamber $\mathbf{10}^1$ and those below the line the filling and emptying of the chamber 10.

The shaded curves 1, 2 and 3 illustrate chamber high pressure cold water filling from the line 122 and the displacement of hot water from the chambers to the hot water main 128. The curves 4, 5 and 6 depict the more rapid chamber filling with pumped hot water from the hot water low pressure lines 132 and displacement of cold water through the valves 20 and $\mathbf{20}^1$ to the tank 126. The curves 7 and 8 show hot water in the hot water low pressure circuit being circulated back to tank 134 through the valve 138 in the dwell times between the faster alternate hot water filling cycles of the chambers 10 and $\mathbf{10}^1$ to enable continuous operation of the hot water pump 136.

The ascending and descending portions A and B of curves 1 and 3 illustrate the opening and closing of valve $\mathbf{18}^1$ into the chamber $\mathbf{10}^1$. The descending and ascending portions C and D of the curve 2 illustrate the opening and closing of valve 18 into the chamber 10. The descending and ascending portions E and F of the curve 4 illustrate the opening and closing respectively of valve 20 from the chamber 10. The ascending and descending portions G and H of the curve 5 illustrate the opening and closing of the valve $\mathbf{20}^1$ from the chamber $\mathbf{10}^1$.

It will be seen from the cycle curves 1, 2 and 3 in the graph that the vertical shading lines extend between the curve lines. It is to be noted that these lines are all of equal length over all portions of and between the three curves and illustrate that the flow rate of the high pressure water from the line 122 is continuous at all times during the cyclic operation of the system as is the flow rate of the hot water into the high pressure hot water main 128. This uninterrupted high pressure water flow to and from the fluid transfer system of the invention eliminates any possibility of the problematical prior art water hammer in the system.

Figure 9:
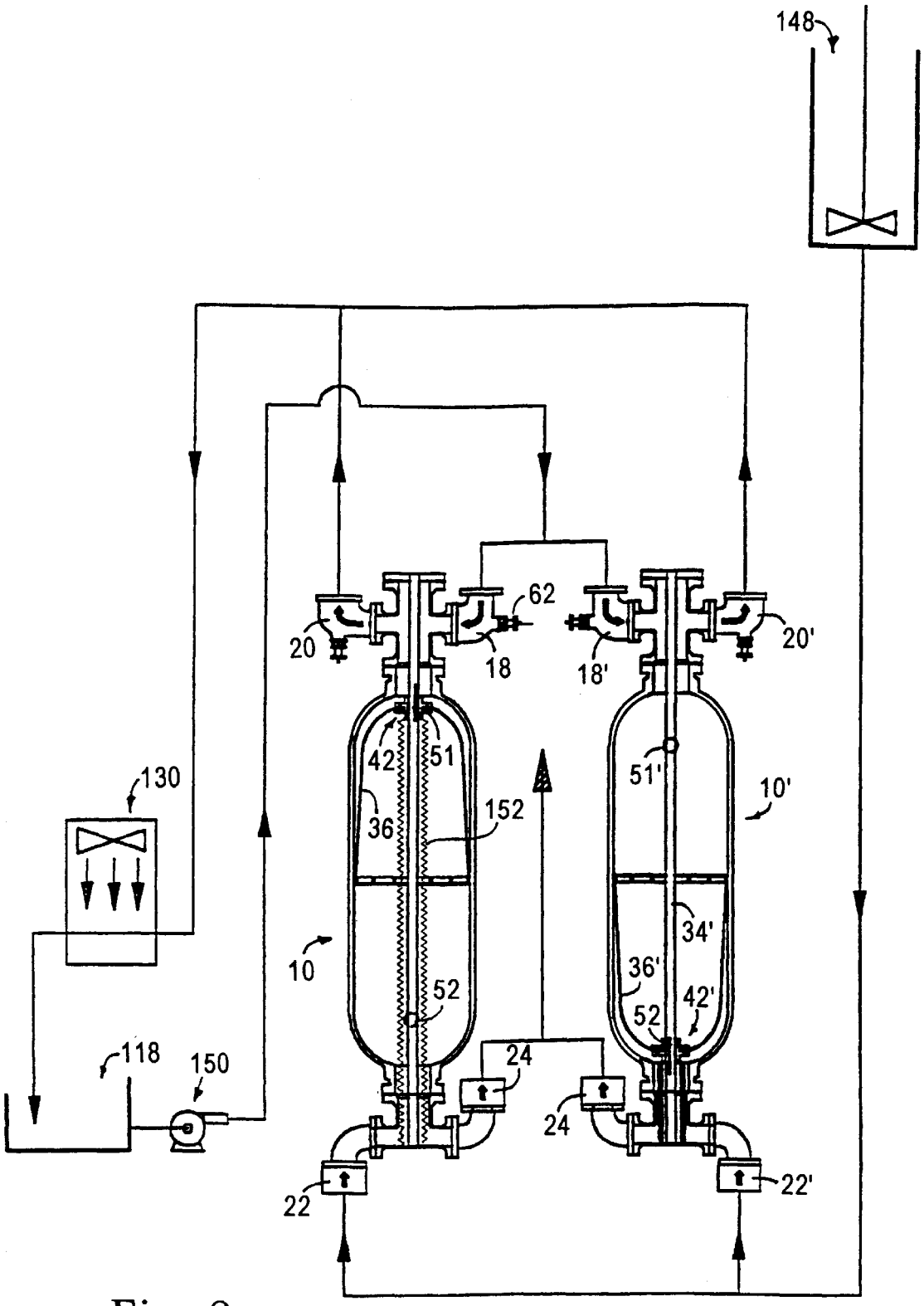
FIG. 9 is a variation of the FIG. 7 system circuit as used for slurry pumping.

FIG. 9 illustrates a variation of the fluid transfer system of the invention as described with reference to FIG. 7 above. This system is intended for the pumping of slurry by means of clean water, either from a mine or over a distance on surface.

In the FIG. 9 system the same reference numbers are used to indicate the same components as those described with reference to FIG. 7.

The slurry pumping system is virtually the same as that of FIG. 7 except that: the chambers 10 and $\mathbf{10}^1$ are vertically mounted to avoid slurry settlement in them, in place of the low pressure hot water in the FIG. 7 system, slurry is preferably gravity fed to the chambers 10 and $\mathbf{10}^1$ from an elevated slurry tank 148 which conveniently includes an agitator for keeping the slurry solids in suspension, a pump 150 which, in the case of surface operation of the system where no water head pressure is available, is a high pressure clean water pump, the chamber rods 34 carry between their chamber slurry inlet and outlet valves 22, 24 and 221 and 24[1] and the bladder shuttles 42 and 42[1] extensible concertina type sleeves 152 to shield the rods and the bladder shuttles from the abrasive slurry. This system operates in the same manner as that of FIG. 7. It is, however, to be noted that no high pressure slurry pumps are employed in any of the slurry lines to eliminate very expensive and time consuming pump or pump component replacements caused by abrasive wear.

As the feeder chambers 10 and 10[1] of the system of the invention are substantially more compact than those of the long pipe chambers in the known systems the excavation costs for the housing of the system of the invention are substantially smaller than would be the case with the known pipe feeders. Cost savings are further amplified by the use of only two chambers as opposed to three and the consequent cost saving of valves and their maintenance.

Because of the much smaller internal surface area of the chambers 10 and 10[1] relative to that of the prior art pipe chambers, the water separating bladder 36 and the thermal insulating material on the inner surfaces of the chambers the thermal stability and efficiency of the system of the invention is far superior to that of known systems. The fact that the chambers of the invention are less in number and far smaller than in the known systems is not a disadvantage to the system of the invention as the water throughput of the system is easily increased or decreased by either running the pumps 120, 136 and 142 at higher or lower speeds. Alternatively, a plurality of twin chamber systems could be connected in parallel with those of the first system across the lines 122 and 128, to cater for increased flow requirements. The advantage of the invention over known prior art systems in this respect is that each of the prior art systems required a dedicated supply line as their cyclic operations were time dependent and therefore any variation in the supply would adversely affect the cycle. Whereas the system of the invention makes it possible to have one main supply line feeding the plural systems of the invention, in which the total flow will automatically be divided between the individual systems whose cycle rate automatically adjusts to suit their supply.

Yet a further advantage of the system of the invention over the known systems is the precise operational timing of the chamber inlet valves 18 and 18[1] through their actuators 62, the hydraulic circuit 100, the chamber switches 51 and 52 and the system controller 102. Additionally, failure of the bladder 36, any of the valves or any out of sequence operation of a valve or chamber switch is immediately detected by the system controller which activates an appropriate alarm.

I claim:

1. A fluid transfer system including two elongated fluid transfer chambers, each having a first end and a second end, a flexible fluid-separating bladder in each fluid transfer chamber, each bladder having a U-shaped cross-section, a closed end and an open end fixed to a side wall of the chamber about the longitudinal axis of the chamber proximal to a central portion of the side wall of the chamber, the length of the bladder between its open and closed ends being such that fluid in the chamber may move the closed end of the bladder between the proximity of the two ends of the chamber, switch means on the closed end of the bladder, electronic switches at each end of each chamber activated by the bladder switch means, fluid inlet and outlet arrangements at each end of each chamber, oppositely directed one-way inlet and outlet valves in the inlet and outlet arrangement at the first end of each chamber for permitting the flow of a driven fluid into and out of the chamber, oppositely directed inlet and outlet controlled valves in the inlet and outlet arrangements at the second end of each chamber for controlling the flow of a drive fluid into and out of the chamber, a plurality of fluid pressure balancing arrangements, each fluid pressure balancing arrangement including a port in one of the controlled valves, an actuator on each controlled valve which is adapted to open and close the valve and the fluid pressure balancing port in the valve, and a control system, responsive to the electronic chamber switches, connected to the actuators of each of the controlled valves for proportionally opening and closing the controlled inlet valves of each chamber in opposite phase to each other and for opening and closing the controlled outlet valves to ensure full volume continuous drive fluid flow through the system based on the positions of the bladders in the chambers and, thereby, the relative positions of the drive and driven fluids in each of the transfer chambers.

2. A fluid transfer system as claimed in claim 1 in which each of the controlled valves includes a housing having an inlet and an outlet, a valve seat in the housing, a valve member which seats on the valve seat to close the valve in the direction of fluid flow through the valve, a valve stem which is connected to the valve member and which is movable by the actuator to open and close the valve and the fluid pressure balancing port to a fluid passage which passes through the valve member.

3. A fluid transfer system as claimed in claim 2 in which the valve member and its seat are circular, the valve member is axially holed, the valve stem is movable in its axial direction in the hole, and the valve stem includes a stop on the downstream side of the valve member for lifting the valve member from its seat, a secondary valve member on the stem on the upstream side of the valve member for closing the pressure balancing port when the valve is closed and for opening the port to balance fluid pressure across the valve member when the valve member is to be opened.

4. A fluid transfer system as claimed in claim 3 in which each of the controlled valve actuators is a hydraulic piston and cylinder actuator which is attached to the valve housing with the piston rod extending from the actuator into the housing to provide the valve stem.

5. A fluid transfer system as claimed in claim 4 including a closed hydraulic circuit which is connected to and hydraulically links the controlled inlet valve actuators for exact opposite concomitant movement.

6. A fluid transfer system as claimed in claim 5 in which the hydraulic circuit includes a change-over switch for reversing the direction of movement of the two actuator pistons on instruction from the control system.

7. A fluid transfer system as claimed in claim 6 in which the hydraulic circuit includes a fluid flow equalizer for ensuring balanced hydraulic fluid volume flow and exact opposite common speed of operation of the two valve actuators.

8. A fluid transfer system as claimed in claim 7 in which each of the chamber outlet controlled valve actuators each includes a dedicated hydraulic circuit for controlling it and the valve on which it is located with the control system being adapted to control the two hydraulic circuits on instruction from the chamber switch means.

9. A fluid transfer system as claimed in claim 1 in which both the drive and driven fluids are liquids and the system includes a line for feeding the drive liquid to the chamber controlled inlet valves at high pressure, a line for feeding drive liquid from the chamber controlled outlet valves to a holding tank at low pressure, a line for feeding the driven liquid through the chamber one-way inlet valves into the chambers, a line for conveying the driven liquid from the chamber one-way outlet valves, a line which extends between the high pressure liquid feed line and the driven liquid conveying line and a one-way pressure relief valve in the line which opens into the driven liquid conveying line.

10. A fluid transfer system as claimed in claim 9 which is situated underground for mine cooling and in which the drive liquid feed line extends to the system from means on surface for feeding cold water into the line under pressure, the line for conveying the driven liquid extends from the system to the surface for conveying relatively hot water from the mine, the low pressure drive liquid line extends from the chamber controlled outlet valves to the underground cold water holding tank from which the water is used for mine cooling and then fed to a hot water tank, the line for feeding the driven liquid to the chamber one-way inlet valves extends from the hot water tank to the valves for feeding hot water into the chambers through the valves and the system includes a pump for pumping the hot water from the hot water tank to the inlet valves, and a one-way dump valve in the driven liquid line between the hot water tank and the chamber one-way inlet valves for dumping the pumped hot water back to the hot water tank when the water pressure in the line exceeds a preset pressure.

11. A fluid transfer system as claimed in claim 9 in which the drive liquid is clean water, the driven liquid is a slurry and the chambers are vertically orientated with their first ends lowermost.

12. A fluid transfer system as claimed in claim 1, wherein each chamber includes a fixed rod which is coaxially located in and extends over the length of the chamber, the chamber switches being carried in a spaced relationship by the rod, and a sleeve in the closed end of the bladder which is slidably located on the rod, the bladder switch means for activating the chamber switches being located on the sleeve.

13. A fluid transfer system as claimed in claim 12 in which the rod is hollow and the chamber switches are located in the rod.

14. A fluid transfer system as claimed in claim 13 in which the rod is made from a non-magnetic material, the chamber switches are magnetically operable, and the bladder switch means is a magnet for activating the chamber switches.

15. A fluid transfer system as claimed in claim 14 including a protective sleeve which is variable in length and is located over the rod between the sleeve and at least one end of the chamber.

16. A fluid transfer system as claimed in claim 1 in which the bladder is made from a thermal insulating material.

17. A fluid transfer system as claimed in claim 1 in which the internal surfaces of the fluid transfer chambers are lined with a thermal insulating material.

18. A fluid transfer system as claimed in claim 1 in which the internal surface of each of the chambers is lined with an abrasion resistant material.

19. A fluid transfer system as claimed in claim 1 in which the length to diameter ratio of each of the chambers is between 2,5 and 3,5 to 1.

* * * * *